US005675214A

United States Patent [19]

Geven et al.

[11] Patent Number: 5,675,214

[45] Date of Patent: Oct. 7, 1997

[54] LOW-PRESSURE DISCHARGE LAMP HAVING HOLLOW ELECTRODES

[75] Inventors: Andreas S. G. Geven; Jeroen C. Langevoort; Henricus L. A. A. Vogels; Patricius W. M. Lepelaars, all of Eindhoven, Netherlands; Hui-Meng Chow, Briarcliff, N.Y.

[73] Assignee: U.S. Philips Corporation, New York, N.Y.

[21] Appl. No.: 530,503

[22] Filed: Sep. 19, 1995

[30] Foreign Application Priority Data

Sep. 21, 1994 [EP] European Pat. Off. ..... 94202708
Jul. 13, 1995 [BE] Belgium ..... 09500622

[51] Int. Cl.[6] ..... H01J 61/09

[52] U.S. Cl. ..... 313/491; 313/356

[58] Field of Search ..... 313/491, 356, 313/550, 551, 562, 566

[56] References Cited

U.S. PATENT DOCUMENTS

| | | | |
|---|---|---|---|
| 2,847,605 | 8/1958 | Byer | 313/491 |
| 3,505,553 | 4/1970 | Piree | 313/491 |
| 3,883,764 | 5/1975 | Johnson et al. | 313/356 |
| 4,117,374 | 9/1978 | Witting | 313/339 |
| 5,387,837 | 2/1995 | Roelevink et al. | 313/493 |
| 5,432,690 | 7/1995 | Van Der Vliet et al. | 362/217 |
| 5,557,170 | 9/1996 | Ooms | 313/635 |

FOREIGN PATENT DOCUMENTS

| | | | |
|---|---|---|---|
| 0562679 | 9/1993 | European Pat. Off. | H01J 61/09 |

*Primary Examiner*—Sandra L. O'Shea
*Assistant Examiner*—Vip Patel
*Attorney, Agent, or Firm*—Walter M. Egbert

[57] ABSTRACT

The low-pressure discharge lamp is discolsed having a lamp vessel into which hollow cylindrical electrodes enter, between which a discharge path extends. At least one of the electrodes has a tube at a distance from an end thereof, the tube extending in the discharge path. The tube is connected to the electrode by electrically conductive means and is coated with electron emissive material. The surface area of the material of the means in cross-section is at most 25% of the surface area of the material of the electrode in cross-section.

18 Claims, 2 Drawing Sheets

LOW-PRESSURE DISCHARGE LAMP HAVING HOLLOW ELECTRODES

BACKGROUND OF THE INVENTION

The invention relates to a low-pressure discharge lamp, comprising a tubular glass lamp vessel which is closed in a vacuumtight manner and which has end portions;

an ionizable filling comprising a rare gas in the lamp vessel;

hollow cylindrical electrodes which enter the lamp vessel each at a respective end portion and which each have an end inside and outside the lamp vessel.

Such a low-pressure discharge lamp is known from EP-A 0 562 679 (PHN 14.189).

The known lamp is of a simple construction which is easy to realise. The hollow cylindrical electrodes therein have a multiple function: they act as electrodes inside the lamp vessel, as current supply conductors and current lead-throughs inside the lamp vessel and in the lamp vessel wall, and also as tubes through which the lamp vessel can be cleaned and be provided with its filling. The lamp vessel may be closed in a vacuumtight manner in that a glass tube is fused to each of the electrodes outside the lamp vessel and is closed at its free end, for example by fusion.

The construction of the known lamp renders it easy to realise lamps of a comparatively small internal diameter, for example 1.5 to 7 mm, and of a comparatively great length of, for example, 1 m or more.

The ionizable filling may comprise a rare gas or a mixture of rare gases, or in addition a component capable of evaporation such as, for example, mercury. The lamp vessel wall may be provided with a fluorescent material. The lamp may be used for lighting purposes, or as a signal lamp, for example with a neon filling as a tail lamp or stop lamp in vehicles. In the latter application the lamp has the advantage over an incandescent lamp that it emits its full light after 10 ms already, instead of 300 ms after being energized.

It is a disadvantage of the known lamp that its luminous flux is comparatively low.

SUMMARY OF THE INVENTION

It is an object of the invention to provide a low-pressure discharge lamp of the kind described in the opening paragraph which is capable of providing an increased luminous flux.

According to the invention, this object is realised in that a tube lies in the extended direction of at least one of the electrodes at a distance from an end thereof, which tube is coated with an electron emitter and is connected to the electrode by electrically conducting means of which the material in cross-sections transverse to the electrode has a surface area which is at most 25% of the surface area of the material of the electrode itself in cross-sections, and which tube is open at least at a side facing the electrode.

The lamp according to the invention was found to provide an increased luminous flux against the same consumed power.

The discharge arc is found to apply itself mainly to the inside of the electrode during starting of the lamp. The arc also hits the tube and raises its temperature. After some time the arc applies itself mainly to the tube and remains there.

The tube assumes a comparatively high temperature during lamp operation. This results in a good electron emission. The electrically conducting means provide the tube with a thermal insulation, so that the electrode itself remains comparatively cool, cooler than the electrode of the known lamp. This manifests itself in the temperature of the electrode at the area where it makes contact with the lamp vessel, and outside the lamp vessel. The lamp vessel and the electrode outside the lamp vessel as a result may be in contact with or in connection with materials which have a comparatively low resistance to heat during operation.

In general, the electrically conducting means form a heat resistance of 50–2000 K/W. If the heat resistance is considerably greater than indicated here, the tube may generally assume a temperature at which evaporation may start to occur. Given a resistance lower than indicated, the effect on the tube temperature is small. It is favourable when the heat resistance is 100–2000 K/W.

The lamp which has only one electrode provided with a tube is highly suitable for DC operation. The electrode with the tube is the cathode then. It is favourable, however, for example for AC operation, when both electrodes are fitted with such a tube.

The electrically conducting means may be formed by a metal wire which is welded to the electrode and to the tube, for example with resistance welds or laser welds. Alternatively, however, said means may comprise two or more wires. This embodiment may be preferable in lamps which are subjected to accelerations during operation, for example owing to shocks or vibrations.

In a favourable embodiment, the tube is integral with the electrode. In that case material has been removed from the shell of a cylinder from which the electrode and the tube were formed over a longitudinal portion thereof, for example by sawing, grinding, drilling, burning, or etching. One or several connections between the tube and the electrode may have been maintained then so as to serve as electrically conducting means. Three such connections distributed over the circumference provide a mechanically strong construction. The wall of the tube is formed, for example, from a solid material, for example the same material as the electrode, for example, the tube is integral with the electrode.

In a favourable embodiment, the wall of the tube is porous. The material from which the tube is made is a refractory metal such as Ni, Mo or Ta or an alloy thereof. This has the advantage that both the adhesion strength and the mount of emitter material that can be adhered to the tube are improved. Furthermore, the heat capacity of the tube is relatively low, resulting in a fast warming-up of the electrode.

Advantageously, the porous material is a gauze as it is easy to handle and has a relatively high strength. The gauze is woven, for example, from a wire having a diameter of the order of a few tens of micrometers and with a density of a few wires per mm.

It is favourable when the tube is internally coated with emitter. Alternatively, however, the tube may be coated externally, or both internally and externally. The discharge are preferentially applies itself to the inside of the tube in the case of internal coating. Any material detached from the tube then remains substantially inside the tube instead of depositing itself on the lamp vessel wall. A tube allows itself to be coated particularly easily both internally and externally when it is immersed in a suspension of emitter material. The external emitter may then act as a spare reservoir if the internal emitter stock should become exhausted towards the end of lamp life.

The thermal insulation of the tube may be chosen through the choice of the distance between the tube and the electrode, the number of connections between the tube and the electrode, and the average cross-section thereof. If the tube and the electrode are an assembled unit, the insulation is also adjustable through the choice of the material of said means, in particular the heat conductivity thereof. Those skilled in the art may readily make this choice in a small test series for each lamp type.

The emitter may be chosen, for example, from emitters known from lamps, for example low-pressure discharge lamps, or mixtures thereof. Highly suitable is an emitter of BaO, CaO, and SrO, for example obtained from equal molar parts of their carbonates. Alternatively, for example, $Ba_xSr_{1-x}Y_2O_4$ may be used, in which x is, for example, 0.75.

The electrode, and thus possibly the tube, may be made of a metal which has a coefficient of expansion which corresponds to that of the glass of the lamp vessel, for example a CrNiFe alloy in the case of lime glass, for example Cr 6% by weight, Ni 42% by weight, and the rest Fe. For a hard-glass lamp vessel, for example of borosilicate glass, an electrode may be used, for example made of Ni/Fe or NiCoFe, for example Ni 29% by weight, Co 17% by weight, the rest Fe, for example with a diameter of 1.5 mm and a wall thickness of 0.12 mm.

Alternatively, the tube in an assembled unit of electrode and tube may consist of, for example, CrNiFe with 18% Cr by weight, 10% Ni by weight, and the rest Fe, or of Ni. The electrically conducting means may then be, for example, NiCr, for example Ni80Cr20 (weight/weight), for example in the form of wire of 0.125 or 0.250 mm In an embodiment of the lamp according to the invention, the tube is open at both ends and is positioned inside the lamp vessel. Practically all radiation generated by the discharge arc is utilized in this embodiment, which is particularly attractive for a comparatively short lamp vessel.

Experiments leading to the invention have shown that the discharge arc enters the electrode around the tube in the case of an emitter applied in a tube arranged inside the discharge vessel, which tube is open at one side, the closed side either facing the electrode or being remote from the electrode. The lamp vessel then shows strong blackening near the tube.

The lamp vessel may be closed in that a glass tube was fused to one or both electrodes outside the lamp vessel and closed. It is alternatively possible, however, that a seal has been made in the electrode tube itself outside the lamp vessel. For this purpose, the tube may have been closed by fusion, for example with a laser, or pinched, or pinched and fused.

In another embodiment of the lamp according to the invention, the tube is positioned outside the lamp vessel in front of the electrode. This has the advantage that material detached from the tube during operation will end up substantially outside the lamp vessel, so that the lamp vessel itself remains clear. The lumen output accordingly remains high during lamp life. This embodiment is of particular importance for lamps whose filling comprises a component capable of evaporation. Since the discharge arc applies itself mainly to the tube during normal operation, the space outside the lamp vessel, where the tube is accommodated, assumes a comparatively high temperature. The evaporation component can thus have a comparatively high vapour pressure.

The opposite side facing away from the electrode may be open, as is the side facing the electrode, or it may alternatively be closed, for example in that it has been pinched.

BRIEF DESCRIPTION OF THE DRAWINGS

A first embodiment of the low-pressure discharge lamp according to the invention is shown in FIG. 1 of the drawing in side elevation, partly broken away.

DESCRIPTION OF THE PREFERRED EMBODIMENTS

Figure 1:
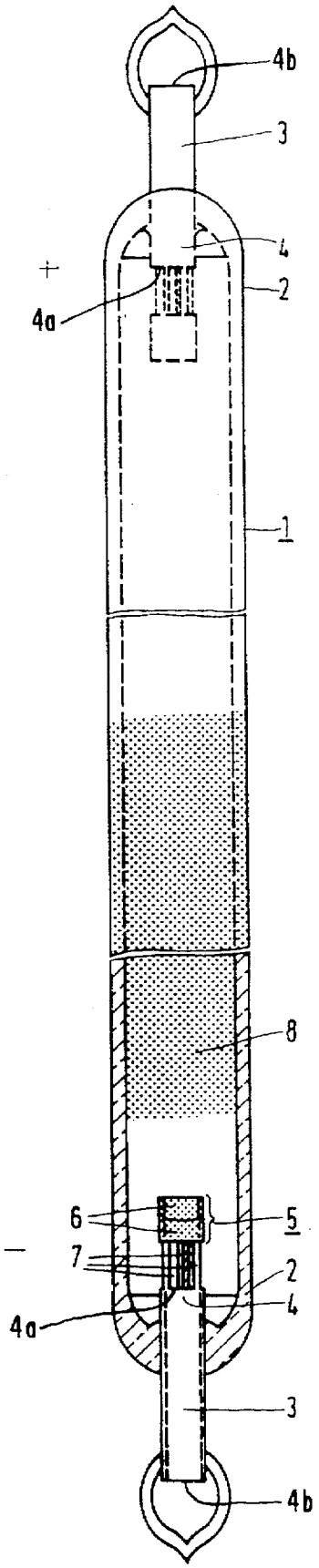

The low-pressure discharge lamp in the drawing has a tubular glass lamp vessel 1 which is closed in a vacuumtight manner and has end portions 2. It has an ionizable filling comprising rare gas, in the drawing a filling of argon and mercury. A mixture of phosphors 8 covers the inner surface of the lamp vessel for the major part. Hollow cylindrical electrodes 3 enter the lamp vessel each at a respective end portion 2 and have ends 4A, 4B inside and outside the lamp vessel.

A tube 5 lies in the extended direction of at least one of the electrodes 3, at a distance in front of one of the ends 4 thereof, i.e. 4A, which tube 5 is open at least at a side facing the electrode, is coated with an electron emitter 6, and is connected to the electrode 3 by electrically conducting means 7 whose material in cross-sections transverse to the electrode has a surface area which is at most 25% of the surface area of the material of the electrode itself in cross-sections.

In the embodiment shown, the tube 5 is open at two sides and is positioned in front of the electrode 3, inside the lamp vessel 1.

The tube is coated with emitter internally and externally. The electrode and the tube form an integral whole. In the FIGURE, both electrodes have such an emitter-coated tube, and the tubes are connected to the electrodes by three connections distributed over the circumference, covering approximately 10% of the circumference in the FIGURE and forming the electrically conducting means.

In a similar lamp having a lamp vessel of lime glass with an internal diameter of 3.5 mm and an external diameter of 5 mm, electrodes of Cr6Ni42Fe52 (weight/weight/weight) were used. The electrodes had an inner diameter of 1.5 mm and a wall thickness of 0.12 mm. A tube having a solid nickel wall open at two ends and of 4 mm length extended in front of each of the electrodes at a distance of 3 mm. The tubes were internally and externally coated with $BaCaSrO_3$. The tubes were supported by a nickel wire of 0.4 mm diameter which in cross-section had a surface area amounting to approximately 6% of the material surface area of the electrode itself in cross-section, resulting in a heat resistance of 320 K/W.

The lamp was compared with a lamp (ref) which had no tubes at the electrodes, but which was identical in all other respects. The reference lamp was operated, as was the lamp according to the invention (inv 1) with 10 mA alternating current. The lamp according to the invention was also operated with 30 mA (inv 2). The voltage across the lamps $V_{1a}$, the power consumption $P_{1a}$, the luminous flux $\Phi$, and the luminous efficacy $\eta$ are listed in Table 1 below.

TABLE 1

| lamp | $V_{1a}$ [V] | $P_{1a}$ [W] | $\Phi$ [lm] | $\eta$ [lm/W] |
|---|---|---|---|---|
| ref | 304 | 3.0 | 135 | 44 |
| inv 1 | 180 | 1.8 | 135 | 75 |
| inv 2 | 163 | 4.9 | 300 | 60 |

It is evident from Table 1 that the lamp according to the invention operated with the same current but taking up a lower power than the reference lamp yields the same luminous flux, and accordingly has a considerably higher luminous efficacy. When the lamp is operated at a higher power (inv 2), the luminous efficacy is higher than that of the reference lamp, as is the luminous flux.

An identical lamp vessel, but not coated with phosphors, and having the same electrodes, tubes with emitter, and electrically conducting means, was filled with 25 mbar neon to which 0.05% argon by volume was added. The lamp (inv 3) was operated with 10 mA direct current and compared with a reference lamp (ref 2) having electrodes without the tubes, but identical in all other respects.

The results are listed in Table 2.

TABLE 2

| lamp | $V_{1a}$ [V] | $P_{1a}$ [W] | Φ [lm] | η [lm/W] |
|---|---|---|---|---|
| ref 2 | 800 | 8 | 120 | 15 |
| inv 3 | 650 | 6.5 | 120 | 18,5 |

The higher luminous efficacy of the lamp according to the invention is evident from the Table, which leads to a higher luminous flux than that of the reference lamp when the same power is consumed as in the reference lamp.

The temperature of the lamp inv 3 was measured in the locations indicated in the FIGURE with a–g, the cathode being at location g. These temperatures are listed with the corresponding temperatures of the reference lamp (ref 2) for comparison in Table 3 below.

TABLE 3

| temp. [°C.] at: | a | b | c | d | e | f | g |
|---|---|---|---|---|---|---|---|
| inv 3 | 45 | 55 | 63 | 47 | 124 | 120 | 71 |
| ref 2 | 60 | 60 | 60 | 50 | 177 | 177 | 230 |

It is evident from Table 3 that the highest measured temperature (e) for the lamp inv 3 is more than 50° C. lower than in the reference lamp. Since the lamp must certainly be held by the projecting portion of the electrode in order to supply it, it is of greater importance for the choice of materials with which the lamp is in connection during operation that the temperature near the cathode in location g is the lowest, and is much lower (71° C.) than in the reference lamp. It is apparent from the temperatures at e–g that the lamp vessel of the reference lamp gets its temperatures mainly through conduction of heat originating from the electrode through the lamp vessel wall. The lamp vessel of lamp inv 3 gets its temperatures mainly through radiation originating from the tube at the electrode.

In an alternative embodiment, the wall of the tube is of a porous material, for example a gauze of a wire having a diameter in the range of 50–100 μm and with a density of 3–5 wires per mm. Suitable materials are, for example, Ni, Mo and Ta. In an embodiment, the tube has a length and an internal diameter of 3 mm and of 1.5 mm, respectively.

Figure 2:
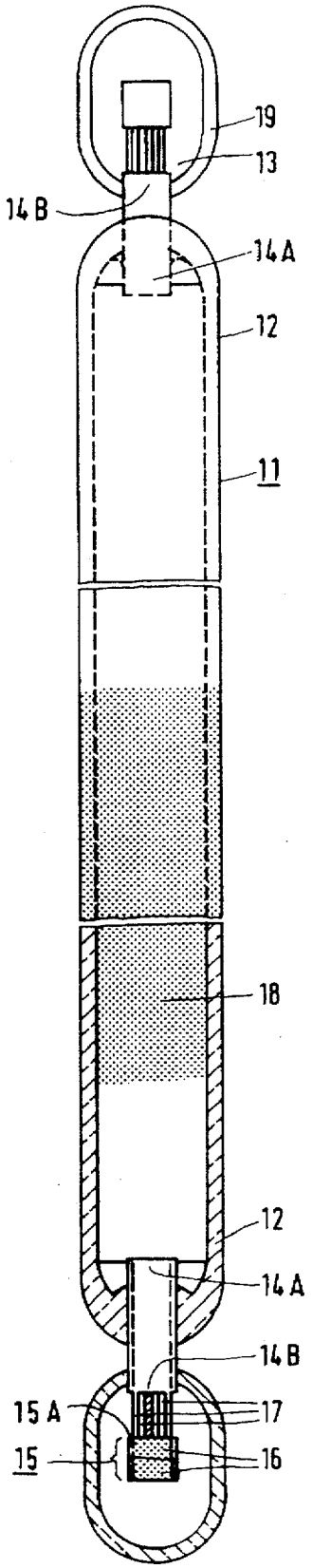
FIG. 2 shows a second embodiment, also in side elevation and partly broken away.

In FIG. 2, components corresponding to those of FIG. 1 have reference numerals which are 10 higher. Lamp properties were measured for lamps of the embodiments of FIG. 1 and FIG. 2, referred to below as inv 4 and inv 5, respectively, after 1 h and 2000 h of operation. The distance between the tubes in lamp inv 4 is 12 cm. Its construction is identical to that of lamp inv 1 in all other respects. The construction of lamp inv 5 differs from that of lamp inv 4 only in that the tube is placed outside the lamp vessel. The distance between the tubes in lamp inv 5 is 14 cm. Lamp construction is the same in other respects, i.e. materials and dimensions of the tubes, electrically conducting means, and electrodes. The lamps inv 4 and inv 5 were filled with 40 mbar Ar and 2 mg Hg. The following lamp properties were measured at a lamp current of 40 mA after a lamp life T (h) of 1 h and 2000 h of operation:

lamp voltage $V_{1a}$ in V, power consumed by the lamp $P_{1a}$ in W, luminous flux ϕ of the lamp in lm, and luminous efficacy η in lm/W, as listed in Table 4 below. The ratio of the luminous efficacy after 2000 hours of operation $\eta_{2000}$ to the luminous efficacy after 1 hour of operation $\eta_1$ is also shown in the Table.

TABLE 4

| lamp | T [h] | $V_{1a}$ [V] | $P_{1a}$ [W] | ϕ [lm] | η [lm/W] | $\eta_{2000}/\eta_1$ |
|---|---|---|---|---|---|---|
| inv 4 | 1 | 76 | 3.0 | 130 | 43.3 | — |
| | 2000 | 82 | 3.3 | 108 | 32.7 | 75.7 |
| inv 5 | 1 | 98 | 3.9 | 162 | 41.5 | — |
| | 2000 | 100 | 4.0 | 138 | 34.5 | 83.1 |

The luminous efficacy of lamp inv 5 after 2000 hours of operation is found to be higher than that of lamp inv 4 in spite of the fact that the radiation generated by the discharge arc in lamp inv 5 is partly intercepted by the electrode because the discharge arc passes through the hollow electrode and applies itself to the tube.

We claim:

1. A low-pressure discharge lamp, comprising a tubular glass lamp vessel which is closed in a vacuumtight manner and which has end portions;

an ionizable filling comprising a rare gas in the lamp vessel; and hollow cylindrical electrodes which enter the lamp vessel each at the respective end portion, the electrodes each having a first end inside the lamp vessel and a second end outside the lamp vessel, characterized in that: a tube lies in the extended direction of at least one of the electrodes at a distance from at least ore of said first and second ends thereof, the tube coated with an electron emitter and connected to the electrode by electrically conducting means of which the material in cross-sections transverse to the electrode has a surface area which is at most 25% of the surface area of the material of the electrode in cross-sections, and the tube being open at least at a side facing the electrode.

2. A low-pressure discharge lamp as claimed in claim 1, characterized in that a wall of the tube is made of a porous material.

3. A low-pressure discharge lamp as claimed in claim 2, characterized in that the tube is open at both sides and is positioned inside the lamp vessel in front of the electrode.

4. A low-pressure discharge lamp as claimed in claim 2, characterized in that the tube is positioned outside the lamp vessel in front of the electrode.

5. A low-pressure discharge lamp as claimed in claim 2, characterized in that the tube is internally coated with emitter.

6. A low-pressure discharge lamp as claimed in claim 2, characterized in that the porous material is a gauze.

7. A low-pressure discharge lamp as claimed in claim 6, characterized in that the tube is positioned outside the lamp vessel in front of the electrode.

8. A low-pressure discharge lamp as claimed in claim 7, characterized in that the tube is internally coated with emitter.

9. A low-pressure discharge lamp as claimed in claim 8, characterized in that the tube is coated with emitter internally and externally.

10. A low-pressure discharge lamp as claimed in claim 6, characterized in that the tube is internally coated with emitter.

11. A low-pressure discharge lamp as claimed in claim 6, characterized in that the tube is open at both sides and is positioned inside the lamp vessel in front of the electrode.

12. A low-pressure discharge lamp as claimed in claim 11, characterized in that the electrode and the tube are integral.

13. A low-pressure discharge lamp as claimed in claim 11, characterized in that the tube is internally coated with emitter.

14. A low-pressure discharge lamp as claimed in claim 1, characterized in that both electrodes have a tube.

15. A low-pressure discharge lamp as claimed in claim 1, characterized in that the tube is open at both sides and is positioned inside the lamp vessel in front of the electrode.

16. A low-pressure discharge lamp as claimed in claim 1, characterized in that the tube is positioned outside the lamp vessel in front of the electrode.

17. A low-pressure discharge lamp as claimed in claim 1, characterized in that the tube is internally coated with emitter.

18. A low-pressure discharge lamp as claimed in claim 1, characterized in that the electrode and the tube are integral.

* * * * *